United States Patent [19]

Connacher

[11] Patent Number: 4,822,107

[45] Date of Patent: Apr. 18, 1989

[54] CUTTER AND METHOD TO REMOVE SURFACE COATINGS

[76] Inventor: Patrick J. Connacher, E. 13726 Misson Ave., Spokane, Wash. 99216

[21] Appl. No.: 93,643

[22] Filed: Sep. 8, 1987

[51] Int. Cl.[4] ..... E21C 25/10

[52] U.S. Cl. ..... 299/10; 299/39; 299/91

[58] Field of Search ..... 299/39, 40, 91, 10, 299/24, 25; 407/59

[56] References Cited

U.S. PATENT DOCUMENTS

| | | | |
|---|---|---|---|
| Re. 29,356 | 8/1977 | Bennett | 299/25 |
| 1,432,579 | 10/1922 | Vauclain et al. | 407/59 X |
| 1,670,502 | 5/1928 | Gray | 299/39 |
| 2,062,232 | 11/1936 | Pogue | 299/39 X |
| 2,197,549 | 4/1940 | Hargrave et al. | 299/39 X |
| 2,584,738 | 2/1952 | Reitz | 299/39 X |
| 3,088,718 | 5/1963 | Lilly | 299/87 X |
| 3,223,451 | 12/1965 | Orr | 299/39 X |
| 3,608,969 | 9/1971 | Fowkes | 199/39 |
| 3,923,341 | 12/1975 | Miller | 299/39 X |
| 4,093,392 | 6/1978 | Hopkins | 407/59 X |
| 4,304,440 | 12/1981 | Posciri | 299/25 X |
| 4,470,210 | 9/1984 | Hahn | 299/91 X |
| 4,476,642 | 10/1984 | Hemphill | 299/91 X |
| 4,557,626 | 12/1985 | McKay et al. | 299/39 X |

*Primary Examiner*—Jerome W. Massie
*Assistant Examiner*—Matthew Smith

[57] ABSTRACT

A cutter-type apparatus is mounted on a tractor for positioning and locomotion to remove coatings from planar supporting surfaces of concrete, steel or similar materials. The apparatus defines a cutter that is variably positionable from horizontal to vertical to remove coatings from surfaces oriented in such directions. The cutter provides a plurality of spaced spirally arrayed teeth, of particular configuration, arrayed on a powdered cylinder to remove surface coatings substantially by cutting and to leave the original supporting surface substantially intact. A cover aids in preventing injury or damage from access to the cutter and, in association with a water spray system, aids in preventing overheating of the cutter and in collecting and containing debris.

4 Claims, 3 Drawing Sheets

CUTTER AND METHOD TO REMOVE SURFACE COATINGS

BACKGROUND OF INVENTION

1. Related Applications

There are no applications related hereto heretofore filed in this or any foreign country.

2. Field of Invention

My invention relates generally to the removal of surface coatings by cutting and more particularly to an apparatus having a plurality of spaced, spirally oriented cutter teeth carried by a rotating cylinder that is movable over the surface to be operated upon.

3. Background and Description of Prior Art

It has become a practice in modern constructions to provide coatings for various surfaces of concrete, metal or similar materials to aid their preservation, assist in their maintenance, improve their ascetics, or otherwise improve them. Such coatings have commonly been provided on metal surfaces such as a ship's deck, bridges and like structures; on concrete surfaces such as floors, sidewalks, vehicular ramps and similar passage ways; and, increasingly, upon open exposed areas for vehicular travel such as airport runways, automotive garages, storage areas and the like. Such surface coatings commonly are relatively thick when compared to ordinary paint coatings, are both strongly adhesive and cohesive, and are of a generally semi-resilient, tough, and chemically unreactive nature, all to make them quite durable for the purposes which they normally serve, but also to render them most difficult to remove when necessary. These surface coatings heretofore known have commonly been formed of settable polymeric and resinous material such as urethane, epoxy, various other plastics, rubber-like compounds, and the like.

Such coatings, once established, do eventually become decrepit from physical wear, natural and environmental deterioration, chemical and physical change or otherwise and thereby require replacement or refurbishment. In general with such coatings as are commonly used in the present day, the old coating must be removed before a new replacement coating may be established. With many of the commonly used coating materials, a replacement coating may not be established over an existing coating, but rather the old material must be removed and a new supporting surface established such as the surface supporting the original coating. By reason of this, it has become necessary to remove the remnants of such coatings that have become decrepit in one fashion or another. My invention seeks to provide both an apparatus and method for so doing.

Such surfaces in the past generally have been removed by grinding or abrasion-type processes which have proven expensive and not too effective. Most of the coating materials that are removed are at least partially thermally plastic and since the abrading process by its nature tends to create substantial amounts of heat, it tends to some degree to plasticize the coating materials being removed to make those materials more difficult to remove, to cause them to partially adhere to the abrading medium to tend to interfere with the abrasion process, and to partially re-adhere to other removed particles and to their original supporting surface. Similarly, the abrasion process, even without the thermal plasticity of the materials involved, is a slow, time consuming one which involves substantial labor to make it economically a quite expensive process. If materials removed by abrasion are not sufficiently plastic or otherwise adapted to agglomerate, the abrasion process also tends to create undue amounts of fine particulate matter that is difficult to capture and collect and which oftentimes passes into the ambient atmosphere to cause pollution and contaminate areas outside those being operated on.

My apparatus and process seek to alleviate these problems by providing a cutting-type process for the removal of such surface coatings. Cutting tools of various sorts have heretofore been used in finer finishing of the surface of materials, such as planars or millers with wood and metal, and in the course removal of substantial portions of a material surface and its underlayment, such as in removing asphalt, tree roots and stumps, flat concrete and the like. My invention provides an intermediate-type cutter that may remove surface coatings of a medial thickness, generally in the range from 10 to 300 mills, without removing substantial amounts of the material of the supporting surface.

To do this, I provide a rotatable cylindrical cutter having a plurality of teeth projecting from the surface thereof to define an axially aligned, cylindrical cutting surface at a spaced distance outwardly from the supporting cylinder. The teeth are spirally arrayed in an axially spaced fashion so that only one, or relatively few, teeth are cutting at any particular time, but yet the cutting operation is continuous to provide a cutting action that generates a minimal amount of heat and yet prevents the chatter and vibration heretofore commonly associated with tooth type cutters, whether the cutter be operated at high or low rotary speeds. The coating removed by my cutter tends to be and remain in relatively small particles that agglomerate, otherwise are large enough so that they remain on the surface from which they were removed rather than pass into the ambient atmosphere.

The particular cylindrical form of my cutter allows it to be positioned with a high degree of precision to remove a coating from its supporting surface. The provision of separate cutting teeth also allows ready replacement of individual teeth when required and one particular tooth form also allows a releasable attachment of the cutting portion of the tooth, if desired, all to make the cutter more economical then one without replaceable teeth, since these elements sustain a substantial amount of the wear in such devices.

My cutter and its associated operative mechanism are generally configured as an auxiliary structure to be carried and positioned by some prime mover such as a small wheeled tractor. The cutting device may generally be powered by the motivating mechanism of the tractor, though in some hydraulically powered systems it may be necessary to use auxiliary devices to maintain hydraulic pressures in view of the higher fluid flows required for operation of my device. In general, small wheeled tractors provide an operating platform which is quite appropriate to provide locomotion for my cutter structure. In general, the locomoting mechanism should allow adjustable positioning of my invention to regulate depth of cut and it is most convenient if such mechanism also allows angular positioning about an axis elongate to the tractor to allow my cutter to accommodate sloping surfaces such as on ramps and the like. Prior art devices in general have not provided this type of mounting, as indeed such mounting generally has not been required for the operation of such devices.

Commonly, most coated surfaces that will require removal are horizontal or substantially so, but sometimes coatings on vertical surfaces, especially those defining the periphery of a horizontal surface, require removal. In this later situation, it is convenient to provide a primary cutter oriented about a horizontal axis and a secondary cutter oriented about a vertical axis to remove coatings from such vertical surfaces. The secondary cutter may conveniently be mounted by a positioning structure at one or both ends of a primary horizontal cutter so that the vertical cutter may extend beyond the lateral periphery of a propelling tractor to allow free and unencumbered use.

My invention further provides a housing for my cutter structures which enclose a substantial amount of the cutter periphery, with only a small sector where cutting actually occurs being open. This provides not only a safety shield to prevent access to the cutter during operation and prevent debris from being thrown randomly by it, but also provides a means to mount and contain a water spray system. Such water spray system sprays water upon the cutter within the housing and the area of its operation upon an adjacent surface. This water aids in containment of debris and also provides coolant to the tooth structure of the cutter and prevents thermal plasticity in the coating being cut. Devices of the prior art in general have not provided water spray upon the surface removing element, either because the water was unnecessary, there was no means of getting the water to the actual surface removing process, or there was no means of containing a water spray.

My invention resides not in any one of these structural features or methods, per se, but rather in the unique synergistic combination of all of them to provide the functions necessarily flowing therefrom.

SUMMARY OF INVENTION

My invention generally provides a rotary cylindrical cutter carried in a housing interconnected to a tractor-like propelling vehicle for adjustable positioning and locomotion.

My cutter provides a mounting cylinder with a plurality of axially and radially spaced teeth projecting therefrom and arrayed in spiral fashion. At least one horizontally oriented cutter is provided and a vertically oriented cutter may optionally be provided. The cutter is journaled in a housing surrounding a substantial portion of its periphery and defining an opening where necessary to allow cutting on an adjacent surface. The housing is provided with water spray means to cool the cutter, the surface being cut and the material removed therefrom. The cutter housing has associated mechanism to allow attachment to a propelling vehicle, regulate vertical position of the cutter relative to the vehicle and preferably regulate angular position of a principal cutter about an elongate axis through the supporting vehicle. An associated water system supplies pressurized water to the spray mechanism.

In creating such a device, it is:

A principal object of my invention to provide a cutting device to remove coating materials from an underlying supporting surface and especially to remove polymeric and resinous coatings of some thickness from underlying rigid supporting surfaces, especially of concrete or steel.

A further object of my invention to provide such a device that has a rotatable cylindrical cutter with a plurality of similar teeth axially and peripherally spaced in a spiral array to provide cutting that generates a minimum amount of heat and vibration but yet is finely adjustable and controllable.

A still further object of my invention to provide such a device that has such teeth configured so that they may be removably positionable on their supporting cylinder and may, if desired, have removably positionable cutting portions.

A still further object of my invention to provide such a cutting tool that is journaled in a housing surrounding a substantial portion of the periphery thereof, with only the actural cutting portion of the tool being exposed, so as to prevent injury from access to the cutting element and the random throwing of material therefrom.

A still further object of my invention to provide such a device that has a water system associated with the housing to spray water upon the cutter blade, a surface being operated upon, and material cut from that surface, all to cool the cutting operation and aid in containment of debris therefrom.

A still further object of my invention to provide such a device that may be powered by a separate prime mover or from the propelling mechanism of an associated vehicle carrying the device.

A still further object of my invention to provide such a device and process that are of new and novel design, of rugged and durable nature, of simple and economic manufacture and otherwise well suited to the uses and purposes for which they are intended.

Other and further objects of my invention will appear from the following specification and accompanying drawings which form a part hereof. In carrying out the objects of my invention, however, it is to be understood that its essential features are susceptible of change in design and structural arrangement with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout.

DESCRIPTION OF PREFERRED EMBODIMENT

Figure 1:
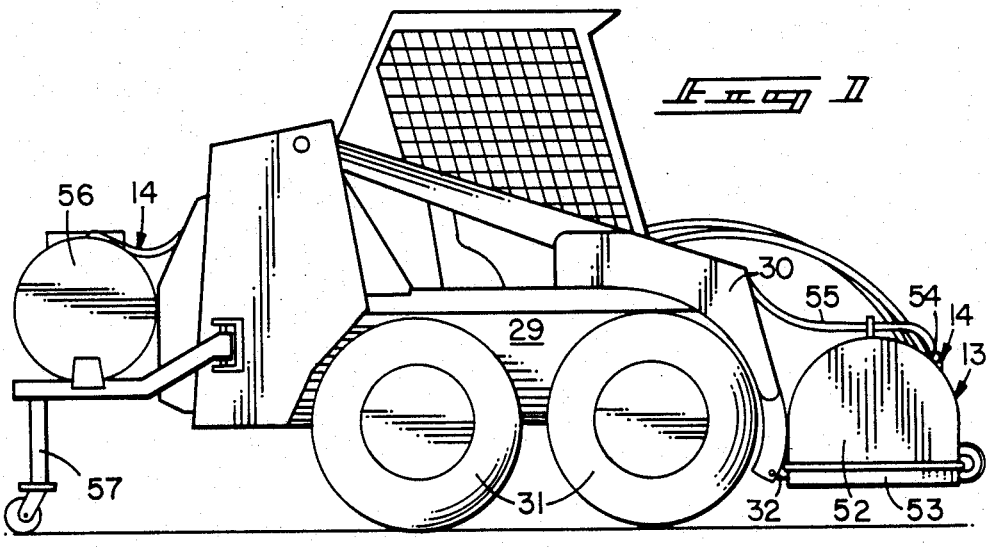
FIG. 1 is an orthographic side view of my invention in operative position on a small wheel tractor of commerce.

My invention generally provides cutter 10 carried in housing 13, at the lateral portion of mounting structure 12, where it is powered by driving mechanism 11 and serviced by water system 14.

Figure 2:
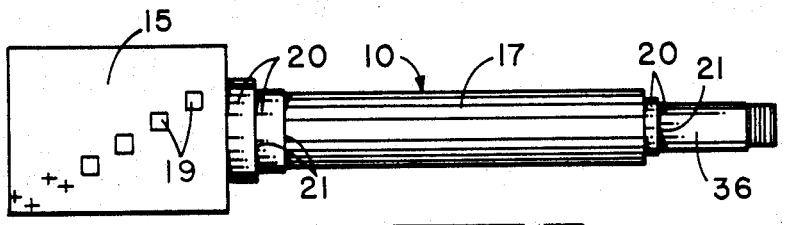
FIG. 2 is an orthographic view of the cutter cylinder of my invention and its associated drive shaft.
Figure 3:
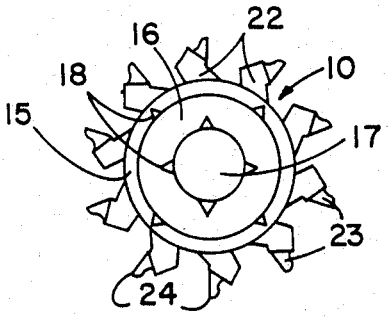
FIG. 3 is an orthographic end view taken from the left side of the cutter cylinder of FIG. 2.
Figures 4, 5:
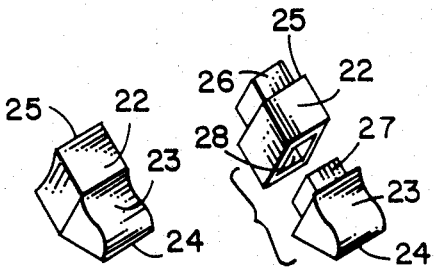
FIG. 4 is a somewhat enlarged isometric view of a cutter tooth of my invention.
FIG. 5 is a somewhat enlarged isometric view of a compound cutter tooth having a removable cutting tip and tenon means to aid joinder to a carrying cylinder.
Figure 6:
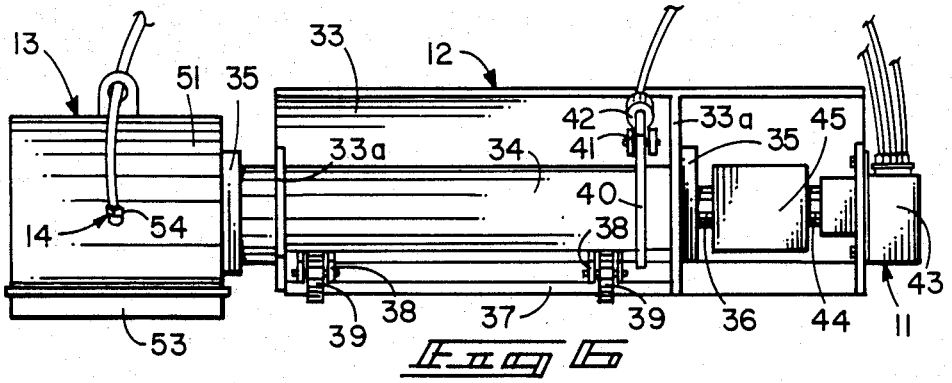
FIG. 6 is a front view of my invention enclosed in its housing and operatively carried on the mounting arms of the tractor of FIG. 1.

My cutter is illustrated particularly in FIGS. 2 through 4 where it is seen to provide cutter cylinder 15, in the instance illustrated irrotatably supported on hub 16, which in turn is irrotatably carried on drive shaft 17. These elements preferably are releasably positionable relative to each other and maintained in irrotatable engagement by known means such as threading, or in the instance illustrated, interfitting spline-groove combinations 18. These elements must withstand substantial stress and must be appropriately sized and configured according to known engineering methods so to do. Drive shaft 17, in the instance illustrated, is of some length to allow mounting of the cutter laterally of a vehicle propelling the implement, as illustrated particularly in FIG. 2. If a stud-type tooth is to be used with my invention, as hereinafter described, appropriate holes 19 for tooth studs are defined in cutter cylinder 15. Commonly, annular bearing bosses 20 will be provided on drive shaft 17 to define shoulders 21 to cooperate with thrust bearings to aid in maintaining the drive shaft in appropriate lateral alignment.

The cutting teeth of my invention provide medial bodies 22 with somewhat wedge shaped cutting portions 23 terminating in a linear cutting edges 24 extending the width of the tooth, that is, in an axial direction with reference to cutting cylinder 15 on which the teeth are mounted. The tooth body may have a flat base 25 to be fastened to the periphery of cutting cylinder 15 by welding or, if desired, it may provide a fastening stud 26 for insertion in a tooth stud hole 19 defined in the cutting cylinder. Tooth cutting portion 23 again may be separately formed from the tooth body and joined to the body by means of stud 27 carried in tenon 28 defined in the joining portions of the tooth body.

The placement and array of teeth on cutter cylinder 15 is critical to the functioning of my invention. The teeth in general should all be of a similar size and shape so that their lineal cutting edges 24 all are contained in and define a cutting surface in the form of a cylinder concentric with, and at a spaced distance outwardly from, the surface of the cutter cylinder. The radial dimension of the teeth normally will be such as to define a cutting cylinder approximately 3 inches larger in diameter then cutter cylinder 15 carrying them.

Each of the teeth, to define the cutting cylinder specified, must be positioned with its lineal cutting edge 24 axially aligned with the axis of cutting cylinder 15. The cutting edge length in this axial dimension must be reasonably limited to allow for undulations in surfaces to be cut, to prevent creation of excessive shear forces on the teeth, and to prevent generation of excessive heat. To accomplish this, the length of the tooth in an axial direction should be approximately 1/20th of the length of the axis of cutting cylinder 15. I prefer that the cutting teeth have a cutting edge of a length of approximately 0.75 of an inch to allow appropriate physical and design parameters.

The spacing and spacial array of the teeth is also critical. The teeth are spaced both radially and axially relative to each other to form a spiral array such that, at ordinary rotary speeds at which the cutter will be operated, some part of the cutting surface of at least one tooth will continuously be in engagement with the surface being cut. To accomplish this, the lineal spacing between teeth in an axial direction must provide the teeth in at least immediate adjacency or preferably a slightly overlapping spacing. The radial spacing preferably arrays the cutting edges of adjacent teeth at a central angle of approximately six degrees. Such spacing will allow the existence of more than one spiral line of teeth on a cutting cylinder with dimensioning as herein specified for such cylinder. The division of the cutting operation amongst a plurality of teeth of smaller dimension tends to lower shear forces on any particular tooth and also tends to generate smaller amounts of heat in each tooth. The maintenance of the cutting edge of at least one tooth always in contact with the surface being cut tends to prevent unwanted vibrations in the cutter cylinder. If this condition were not met, since the cutter cylinder normally is maintained with some pressure against the surface being operated upon, that cylinder would tend to move toward the surface being cut when teeth were not in cutting and supporting contact with that surface to cause vibration or "chatter".

My mechanism is commonly carried on a vehicle for both locomotion and operative positioning. The preferred vehicle is a small wheeled tractor 29, such as illustrated. Such tractors commonly provide paired opposed tool arms 30 which define connecting mechanism in their outer end parts for releasable interconnection with various implements and are provided in the tractor mechanism itself with means for adjustable vertical positioning. Such tool arms 30, in the case illustrated, are of the so called "front loader" type which position the tool forwardly of tractor 29 and allow its relatively fine adjustable positioning in a vertical plane extending both somewhat below and above a surface supporting wheels 31.

Mounting structure 12 of my invention provides principal rigid frame 33 structurally carrying various subframe elements **33*a* to interconnect and support the various elements of my invention in an integral implement. The principal frame member carries connecting bracket 32 to aid releasable interconnection with tool arms 30 of a supporting vehicle. Cylindrical cutter drive shaft housing 34 is horizontally oriented between vertical subframe elements 33*a* to carry opposed drive shaft bearings 35 in its end parts to journal cutter drive shaft 17 and provide thrust structures to maintain this drive shaft in lateral alignment. Drive shaft 17 is of sufficient length that portion 36** projects laterally, to the right in the illustration, to provide driving interconnection and projects to the left of the left drive shaft bearing to establish the cutter cylinder laterally of the lateralmost extension of a propelling vehicle.

Elongate guide wheel rod 37 extends between vertical subframe elements **33*a* where it is pivotally carried in a position forwardly and beneath drive shaft housing 34. The guide wheel rod carries two radially extending guide wheel mounting arms 38, each journaling guide wheels 39 in its outer part. Moving arm 40 extends upwardly, in an angled relation with the guide wheel mounting arms, to communicate with linkage 41, pivotally interconnecting the moving arm with hydraulic cylinder 42, which in turn is interconnected to the principal frame. With this structure, a vertical position of guide wheels 39 relative to the mounting structure 12 may be regulated by cylinder 42**, to provide a means of support for the mounting structure on a surface being operated upon, but yet allow adjustable motion of the structure relative to that surface.

Figure 7:
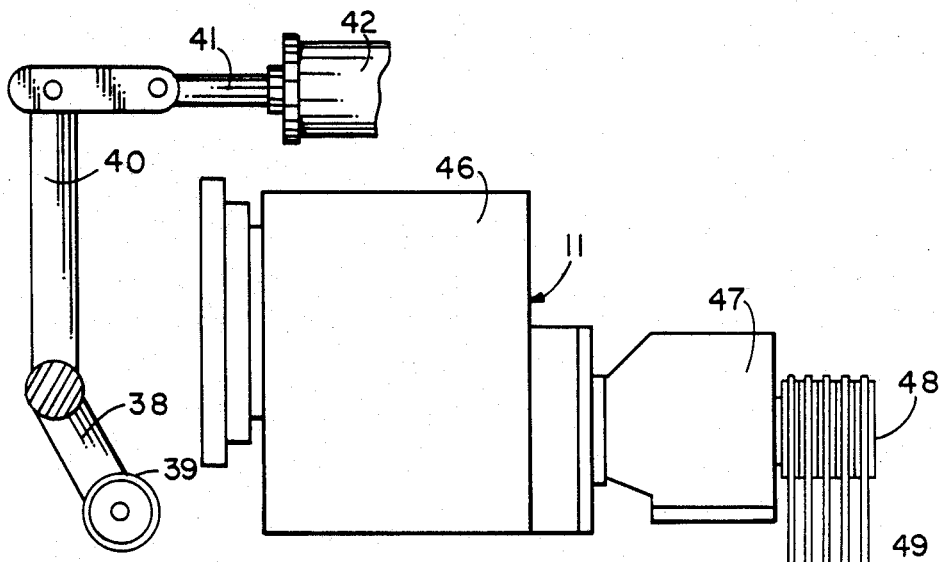
FIG. 7 is a somewhat enlarged partial orthographic side view of the guide wheel moving linkage shown in FIG. 6.

Driving mechanism 11 provides means to rotate the cutter cylinder, preferably at speeds ranging adjustably upwardly to about 500 revolutions per minute. Commonly, the motivating power may be provided by a vehicle mounting my invention for locomotion and that form of powering is illustrated in FIG. 7. The hydraulic motor 43, carried in the lateral portion of mounting structure 12 opposite the cutter head, drives motor shaft 44 which in turn communicates through transmission-clutch mechanism 45 to the end part of cutter drive shaft 17. Hydraulic motor 43 is provided with motivating pressurized hydraulic fluid from the hydraulic system of tractor 29. If the tractor hydraulic system does not allow sufficient fluid flow, it may be necessary to provide known accessory mechanism to provide appropriate additional fluid flow.

Figure 8:
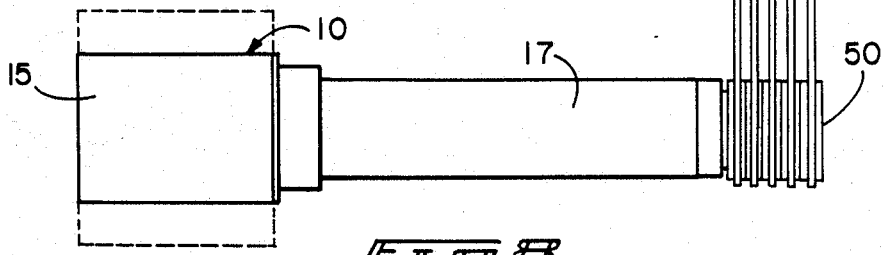
FIG. 8 is a view of a species of my invention showing its powering by an independent motor mounted on its housing.

In larger versions of my cutter structure, having cylinders substantially more than 16 inches in length and 18 to 19 inches in diameter, it may be necessary to provide a separate auxiliary powering system. Such a system is illustrated in FIG. 8 where it is seem to include internal combustion motor 46 carried on mounting structure 12. The internal combustion motor drives transmission 47 which in turn drives multi-belt pulley 48 that communicates by plural belts 49 with multi-belt pulley 50 irrotatably carried on cutter drive shaft 17. The power requirements for my cutter may at times be relatively high and if so, it is advisable to provide separate motivating power rather than to overtax the hydraulic system of a propelling vehicle.

Cutter housing 13 provides shield member 51 with similar opposed ends 52 structurally communicating therewith to define a half cylindrical chamber within which my cutter may rotate but yet covers the cutter except in a downward direction. This housing structure is carried by cutter shaft housing 32 in a rigid irrotatable fashion. Preferably the housing provides depending flexible flaps 53 about its lower periphery to allow some vertical adjustment of the cutter and mounting structure relative to an underlying surface but yet substantially enclose any gap between that underlying surface and the cutter housing. This housing provides a safety shield to prevent access to the cutter structure and also acts as a debris shield to prevent any material cut by the cutter from flying about randomly.

The housing also provides a means for mounting spray heads 54 of my water system 14. At least one spray head 54 is attached on the inner housing surface through a hole defined in housing element 51 to spray water on cutter cylinder 15 and a working surface therebeneath. Depending on the size of a particular cutter and the individual parameters of spray heads, it may be necessary to use a plurality of such heads arrayed in spaced positions on housing element 51. The spray heads are supplied with water through conduit 55 and pump means (not shown) from reservoir 56, in the instance illustrated in FIG. 1 comprising a tank carried on a wheel supported trailer-like structure 57 at the rear of a propelling tractor. The pump pressurizing water for spraying may be supported on the reservoir and is preferably powered by the hydraulic system of a propelling tractor, according to principles heretofore known in the machinery arts. For convenience, reservoir 56 should be of an appropriate size to allow operation of my device for some substantial period of time without refilling.

Preferably, the mounting structure, associated driving mechanism and cutter housing are all configured and interconnected to provide substantial lateral balance for my mechanism relative to tool arms 30 of a carrying tractor so as to provide easier operation and more lateral stability for that tractor.

My cutter most generally will be used to remove surface coatings from a substantially planar surface upon which a carrying tractor is supported and, in this case, mounting structure 12 may be directly carried as described by the tool arms 30 of a tractor. As specified and so carried, it will tend to cut a planar surface parallel to that which supports a tractor. In some instances, however, such as in the case of ramps or the like, it may be desired to cut a planar surface that is angled to the plane of the surface supporting a mounting tractor and in such case, it may be desirable to mount the mounting structure for pivotal motion about a medial axis extending longitudinally of the propelling tractor. This type of mounting may be accomplished by mechanism and structures heretofore known in the implement arts and if used, such structure should be of a type that allows relatively fine angular adjustment of the mounting structure. Since such type of mounting mechanism is known in mechanism arts, the mechanism and method of mounting is not described in detail as it constitutes no essential part, per se, of my invention.

Figure 9:
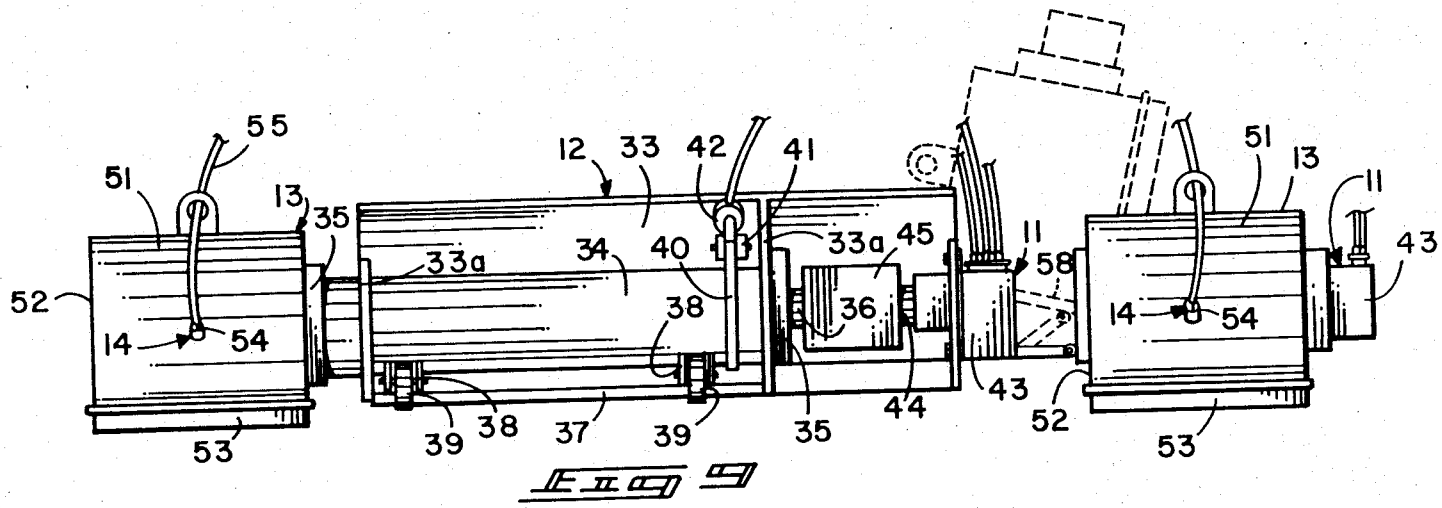
FIG. 9 is a front view of a species of my invention having a vertically positionable cutter element with an operative position of the element shown in phantom outline.

In some instances, it may be desirable to remove surface coatings from vertical surfaces, such as walls. This is especially true in parapet type walls defining an edge or periphery of a horizontal surface, such as in an automotive garage or the like. Obviously, the form of my invention previous described is not adapted for such purposes. A species of my invention that will perform this function is illustrated in FIG. 9 where there is seen an auxiliary structure provided at the right end of the primary structure, heretofore illustrated and described, to operate on vertical surfaces. The cutting structure itself is substantially similar to cutter 10 heretofore described and it is carried in a housing 13 with water system 14 similar to that heretofore described. A separate driving motor is provided, but a tractor's hydraulic system might be used if appropriate power transmitting interconnections were provided.

Mounting structure **12*a* for the vertical cutter illustrated in FIG. 9 provides pivotal supports 58 which allows the device to be positioned in an orientation with the axis of cutter structure 10** substantially vertical. This mounting structure may take various forms, as heretofore known in the mechanical arts dealing with implement and apparatus mounting. Normally the mounting of the vertical form of cutter should allow the lowermost portions of the cutter to extend to, or very near to, a horizontal surface supporting a tractor carrying the device, so that coatings may be removed to a position on a vertical wall very near the level of an adjacent floor.

Having thusly described the structure of my invention, its operation and the process of removing surface coatings with it are readily understandable.

To use my cutter, it is merely necessary to rotate it and move it over a surface from which a coating is to be removed with the cutting circle of the cutter at the depth desired, normally the average level of the supporting surface of an underlying coating. The effectiveness and efficiency of my cutter will vary with the parameters involved, and especially the speed of rotation of the cutter and the speed of its lineal motion over a surface to be removed. Since these parameters relate both absolutely and relatively to the cutting operation, it is most desirable and advantageous to have means of adjustably varying these parameters and preferably my invention does this.

For use, my invention is mounted on some propelling vehicle, commonly a tractor having vertically adjustable tool arms. The tractor should be capable of reasonably consistent lineal speeds in the 0.5 to 5 mile per hour range, should provide a reasonably stable platform for carrying my implement, and should have means of reasonably finely vertically positioning it. I have found a typical front end loader made by the Melrow Company of Fargo, N. Dak. and commonly known under that company's trademark, "Bobcat", to be quite ideal for such support and positioning of my implement.

Preferably the rotary speeds of my cutter shaft should extend through a range up to approximately 500 RPM. As indicated, these speeds preferably are adjustably variable, either by means of the driving motor itself or an auxiliary speed regulating transmission as known in the mechanical arts. Commonly with use of hydraulic motors, it is more convenient to use a transmission then to regulate the speed of the motor, per se. Smaller versions of my invention commonly will be powered by a hydraulic motor powered by the hydraulic system of a propelling tractor.

To use the form of invention described in the specific embodiment, it is attached to the tool arms of a small tractor, as illustrated, for support and vertical motion. The tractor is then appropriately positioned on a horizontal surface to be removed and the motor of the device activated to rotate the cutter. In this condition, the tool arms of the tractor are lowered to move the cutter head to a position such that its cutting circle, through the cutting edges of its plurality of teeth, describes a cutting line at a spaced distance below its axis that is substantially coincident with and contained in a plane through the adjacent surfaces of a coating to be removed and the supporting surface carrying such coating.

The water spray is then activated to spray water upon the cutter and the area of surface being operated upon. The cutter is then moved, normally in a linear course, along the surface to be removed at lineal speeds indicated and as appropriate for efficient coating removal, depending upon the particular coatings and surfaces involved, but usually at a rate of one-half to one and one-half miles per hour. Preferably the speed of linear motion of the cutting tool is reasonably uniform.

It should be noted that in general most industrial surfaces from which coatings are to be removed will be planar to a gross extent, but do usually have minor irregularities deviating from a plane and because of this, in removing surface coatings, some averaging and adjustment must be resorted to. If all surface coating is to be removed, any protuberances within the underlying supporting surface that extend above the lowest points of coating must be removed in order to remove all of the surface coating. On the other hand if no part of a supporting surface is removed, parts of a surface coating will remain in indentations in the underlying supportative surface. My tool is appropriately designed to be capable of removing portions of some supporting surfaces, especially of a cementuous nature. If coating be removed from a steel surface such as a ship deck, normally the steel surface itself will not be removed by my invention, or at least the cutter is not particularly designed for such activity. On hard metallic surfaces any remnants of the coating that do remain in indentations may be subsequently removed by chemical means or abrasion, but those processes may be much more readily accomplished because the substantial bulk of the surface coating will already have been removed by my cutter.

It should further be noted that undulations and protuberances in a surface that affect my cutter will vary somewhat directly with the size of the cutter, or more specifically, the length of the line of cutting contact between cutter and the underlying surface. In other words, with a cutter of the dimensions described, approximately 16 inches long, undulations of dimensions above 16 inches will have little effect upon the cutter's action.

In propelling my cutter for operation on a surface to be removed, it must be positionally maintained with some amount of force as the cutting operation itself tends to cause a reaction that will move the cutter away from a surface being cut. This force will vary particularly with the size of the cutter involved and to some degree with its speed, but a supporting vehicle having an appropriate reaction force will have to be provided. Normally the type of small tractor described provides sufficient gravity bias to appropriately positionally maintain my cutter during locomotion, though in larger versions of the cutter it may be necessary to add weights or use larger vehicles to provide appropriate positional maintenance.

The use of my cutter on a vertical surface is substantially the same as on a horizontal surface, though oftentimes it may be more difficult to positionally maintain the cutter. Normally in moving a carrying vehicle during a cutting operation with a cutter vertically oriented, it is more difficult to maintain exact depth of cut. This may be assisted by the guide wheels carried by the mounting structure of my device. These guide wheels provide a multiple point support relative to the surface being worked upon and also tend to damp vibrations that might be caused in the cutting operation.

The cutting operation, per se that is accomplished with my tool is overall continuous but discrete and sequential insofar as any particular cutting tooth is concerned and with a particular tooth lasts only for a short period of time. As the cutter tooth is rotated by the cutter cylinder, each individual tooth enters a surface to be removed, and when it reaches its maximum depth therein, immediately moves outwardly therefrom to remove a small portion of a surface that is within the boundaries defined by this motion of the tooth's cutting edge. This limits the force upon any single tooth and also limits the heat or energy generated by any individual tooth. Obviously the number of teeth on a cutter and their spiral arrangement should be so regulated with the lineal speed of the cutter over a surface being removed so that successive cuts by the teeth tend to completely or substantially completely remove a surface immediately therebeneath. This will be accomplished within the limits of the various parameters hereinbefore specified.

Normally a surface will be removed in one pass of my device thereover but this is not necessary and obviously the tool might be moved over the same surface more than one time. This may be especially desirable in the case of particularly hard or brittle surfaces, surfaces otherwise difficult to remove, or exceptionally thick coatings. Commonly if more then one traverse of the device over a surface is desired, it is usually preferable to accomplish such action by following courses of travel during the different traverses that are angularly oriented to each other to obtain best coating removal.

It should be noted from the foregoing description that water sprayed upon my cutter head and the working area about a surface being removed will tend both to cool the cutter and surface and at the same time wet any particulate matter removed. This not only reduces the heat that might be generated by my process, but also, in wetting the removed particulate material, tends to cause that material to agglomerate, especially as to finer particles. The removed material is then merely left upon the surface from which it was removed in a wetted layer that may be readily removed for disposal.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and what I claim is:

1. An implement for removing an adherent, semi-thermal plastic coating from a rigid underlying supporting surface without removing any substantial portion of that underlying surface when the implement be moved over that underlying surface in a direction perpendicular to the axis of a cutter comprising, in combination:

an elongate first cutter shaft;

a first cutter cylinder irrotatably carried at a first end portion of said cutter shaft;

a plurality of cutter teeth carried in spaced array by said first cutter cylinder to define a cylindrical cutting surface concentric about said first cutting cylinder and at a spaced distance radially outwardly therefrom, said cutter teeth having similar configuration, and being fixedly carried by the cutter cylinder, in axial adjacency and radially spaced relationship about the surface of the cutter cylinder, defining cutting edges oriented parallel to the cutter cylinder axis, and being arrayed spirally on the cutter cylinder with only one cutter tooth always in contact with a surface coating being cut;

mounting structure journaling said first cutter shaft for rotary motion about a horizontal axis;

a first housing carried by the mounting structure, defining a chamber for rotation of the first cutter cylinder and covering a substantial portion of the periphery of said first cutter cylinder with an opening allowing access of that cylinder to an underlying surface to be operated upon; and means for powering said first cutter shaft for rotation and means for adjustably positioning said first cutter cylinder over a surface to be removed and of lineally moving said cylinder over that surface; and a second auxiliary cutter structure pivotally mounted at one lateral end of the first housing for selective, substantially vertical orientation immediately laterally of the first housing to allow horizontal motion of the second auxiliary cutting structure along a vertical surface laterally adjacent a course of travel of the first housing.

2. A process for removing a coating from an underlying rigid supporting surface comprising the steps of:

forming a cutter cylinder having a plurality of axially adjacent and radially spaced cutter teeth with lineal cutting edges defining a cylindrical cutting surface coincident with and at a spaced distance radially outwardly from said cutter cylinder, said cutter teeth rotating said cutter cylinder at speeds up to 500 revolutions per minute;

locomoting said cutter cylinder over a surface to be removed in a direction perpendicular to the axis of said cutter cylinder, at speeds up to 2 miles per hour and at a spaced distance above said surface with the cylindrical cutting surface of said cutter cylinder extending into the surface to be removed.

3. The process of claim 2 further characterized by:

spraying water upon the cutter cylinder and the surface to be removed beneath the cutter cylinder.

4. A cutter to remove an adherent, semi-thermal plastic surface coating from an underlying rigid supporting surface without removing any substantial portions of that supporting surface when moved over that supporting surface in a direction perpendicular to the axis of the cutter comprising, in combination:

an elongate cutter shaft having means for rotary motion and locomotion parallel to the axis of rotary motion, said cutter shaft irrotatably carrying thereon a cutter cylinder having a plurality of cutter teeth, said cutter teeth being of similar configuration having cutting edges substantially one-twentieth the length of the cutting cylinder, and spaced axially and radially about the surface of that cutter cylinder, with a central angle between adjacent cutter teeth at the cutter cylinder axis of substantially six degrees, to define a cylindrical cutting surface concentric with the cutter cylinder and at a spaced distance therefrom, and defining cutting edges oriented parallel to the cutter cylinder axis and being arrayed spirally on the cutter cylinder with adjacent teeth having their adjacent ends in the same cylindrical circle and only one tooth always in contact with a straight line in said cylindrical cutting surface.

* * * * *